US005092318A

United States Patent [19]

More et al.

[11] Patent Number: 5,092,318

[45] Date of Patent: Mar. 3, 1992

[54] ORTHOPEDIC SUPPORT APPARATUS AND MANUFACTURING PROCESS

[75] Inventors: Marcos A. More, Knoxville, Tenn.; Paul B. Gamm, Cincinatti, Ohio

[73] Assignee: K. T. Medical, Inc., Knoxville, Tenn.

[21] Appl. No.: 707,262

[22] Filed: May 24, 1991

Related U.S. Application Data

[63] Continuation of Ser. No. 533,471, Jun. 5, 1990, abandoned, which is a continuation-in-part of Ser. No. 117,756, Nov. 5, 1987, Pat. No. 4,905,692, and Ser. No. 387,706, Jul. 31, 1989, abandoned.

[51] Int. Cl.[5] ..... A61F 5/10

[52] U.S. Cl. ..... 602/27; 602/63; 602/65

[58] Field of Search ..... 128/77, 165, 878, 80 D, 128/DIG. 5; 66/200

[56] References Cited

U.S. PATENT DOCUMENTS

| | | | |
|---|---|---|---|
| 2,319,340 | 5/1943 | Nebel | 66/200 |
| 4,084,586 | 4/1978 | Hettick | 128/80 C |
| 4,474,573 | 10/1984 | Detty | 128/80 C |

*Primary Examiner*—Richard J. Apley
*Assistant Examiner*—Lynne A. Reichard
*Attorney, Agent, or Firm*—Bailey & Hardaway

[57] ABSTRACT

An improved wrist brace is described wherein the improvement comprises the brace being formed generally from one piece of fabric having uniform elasticity, the fabric being folded and sewn in such a manner to provide tension in the carpal ligament area which is greater than the tension over other areas and provides an angled compression tube of 32°. An alternative embodiment illustrates an orthopedic support apparatus constructed of two way stretch fabric having a ravel-free severed end portion joined flatly to and abutting another portion of the fabric and stitched thereto. The process of the invention describes an improved method of manufacturing orthopedic supports.

4 Claims, 6 Drawing Sheets

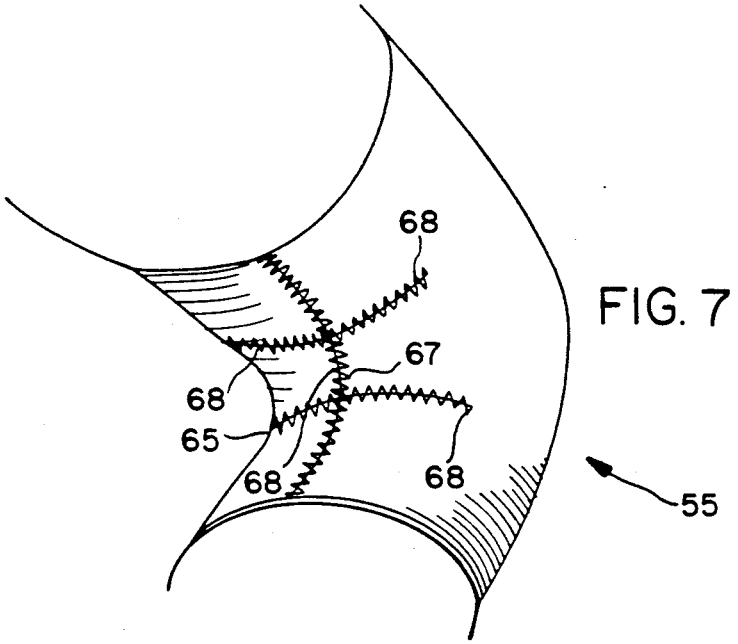
FIG. 7
FIG. 8
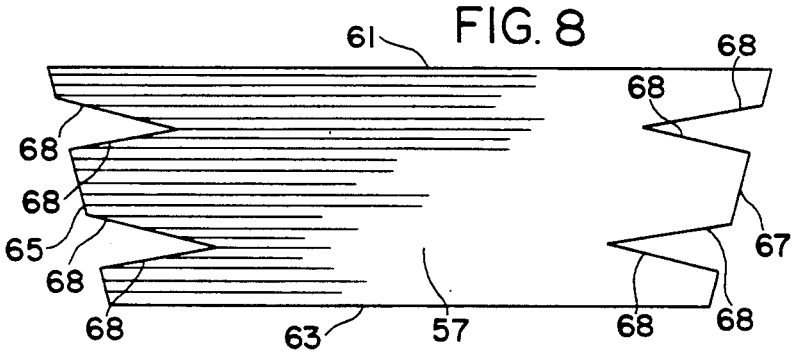
FIG. 9
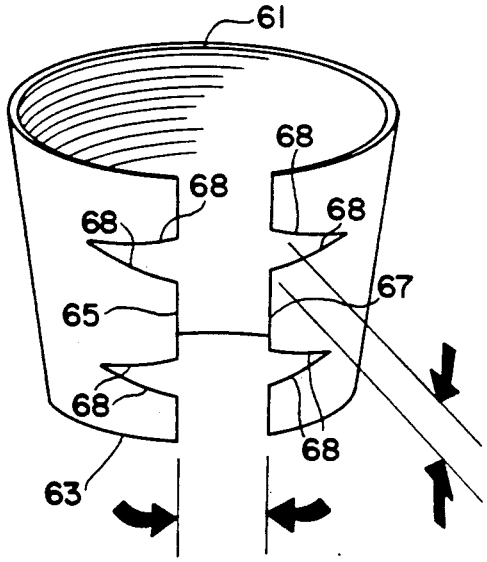

ORTHOPEDIC SUPPORT APPARATUS AND MANUFACTURING PROCESS

This application is a continuation of application Ser. No. 07/533,471, filed Jun. 5, 1990, abandoned, which is a continuation-in-part of U.S. Ser. No. 07/117,756, filed Nov. 5, 1987, now U.S. Pat. No. 4,905,692, and U.S. Ser. No. 07/387,706, filed July 31, 1989, now abandoned.

BACKGROUND OF THE INVENTION

This invention relates to orthopedic supports and more particularly to improvements in the manufacture of orthopedic supports.

Numerous wrist braces and other supports have been provided in the past to position injured extremities for proper healing. One such device is shown in U.S. Pat. No. 3,327,703. While these devices have performed the purpose for which they were intended, they have suffered from a significant drawback. Namely, arduous cutting and costly sealing or locking of elastic edges of fabric have made the prior art devices expensive to manufacture.

SUMMARY OF THE INVENTION

It is thus an object of this invention to provide a novel orthopedic support apparatus.

It is a further object of this invention to provide a wrist, ankle, knee and other braces which are less expensive to manufacture than prior art devices.

It is a further object of this invention to provide a novel orthopedic support apparatus manufactured from two-way stretch fabric.

It is also an object of this invention to provide a novel process for the manufacture of an orthopedic support apparatus.

Some of these objects are accomplished by an improved wrist brace comprising a sleeve defining elastic body having a thumb opening therein, the body extending from the wearer's fingers to below the wearer's wrist and, therefore, covering the wearer's carpal ligament, the improvement comprising the brace being formed from a single piece of fabric with uniform elasticity, the fabric being folded and sewn to provide greater tension in the fold thereof adjacent the carpal ligament.

Other objects are accomplished by an orthopedic support apparatus comprising two-way stretch fabric having a ravel-free severed-end portion joined flatly to and abutting another portion of the fabric and stitched thereto.

The process of the invention is carried out by providing a fabric having uniform elasticity forming a folded pleat having two longitudinal edges in the fabric, stitching the longitudinal edges of the pleat so that the folded pleat is sewn to the remainder of the fabric thereby resulting in an area of greater spring constant adjacent areas of lesser spring constant in the fabric.

BRIEF DESCRIPTION OF THE DRAWINGS

FIG. 7 of the drawings is a perspective view of an alternative embodiment of the invention as it appears when worn as a knee brace showing a fraction of the human leg.

FIG. 8 of the drawings is a plan view of the embodiment of FIG. 7 spread flatly with the stitching removed.

FIG. 9 of the drawings is a perspective view of the material of FIG. 8 illustrating the manner in which the material must be folded to form the embodiment of the invention shown in FIG. 7.

DETAILED DESCRIPTION

In accordance with this invention, it has been found that a wrist brace may be provided with areas of varying elasticity when manufactured from one piece of uniformly elastic fabric. The fabric is folded and sewn according to the process of the invention to accomplish results previously attainable only when several pieces of nonuniformly elastic fabric were used. It has further been found that two-way stretch fabric may be employed in an orthopedic support apparatus allowing a severed end portion to be joined flatly to and abutting another end portion. The instant invention, therefore, allows various orthopedic supports to be manufactured at lower costs than heretofore attained.

Figure 1:
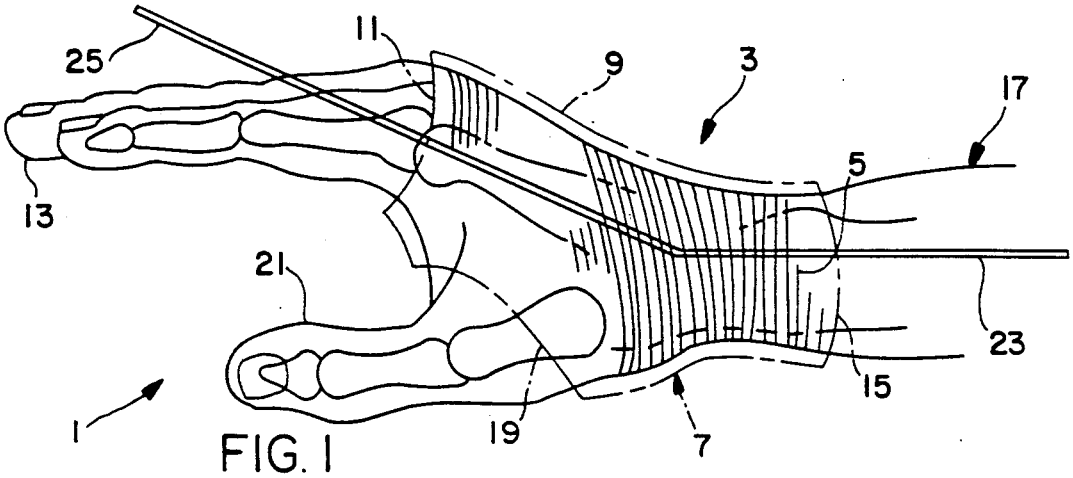
FIG. 1 of the drawings is a radial view of the human hand showing some of the bones and ligaments therein, and further showing an embodiment of the invention in phantom as it would appear on the hand with an approximate 32° angle.

FIG. 1 shows a human hand indicated generally at 1 with some of the bones and ligaments therein. Directly adjacent the hand is the wrist indicated generally at 3. The carpal ligament 5 can be seen to encircle the wrist. The wrist brace 7 of the invention is shown in phantom form as it would appear on the hand and wrist. The wrist brace 7 comprises a sleeve defining elastic body 9. The body 9 has an outer edge 11 near the fingers indicated at 13 and an inner edge 15 below the wrist on the wearer's arm shown generally at 17. The body 9 also has a thumb opening 19 allowing the thumb indicated at 21 to move freely. The brace 7 maintains the hand in a slightly angled position approximately 32° as shown by lines 23 and 25. As is known in the art, this angled position is preferred for proper healing.

Figure 1A:
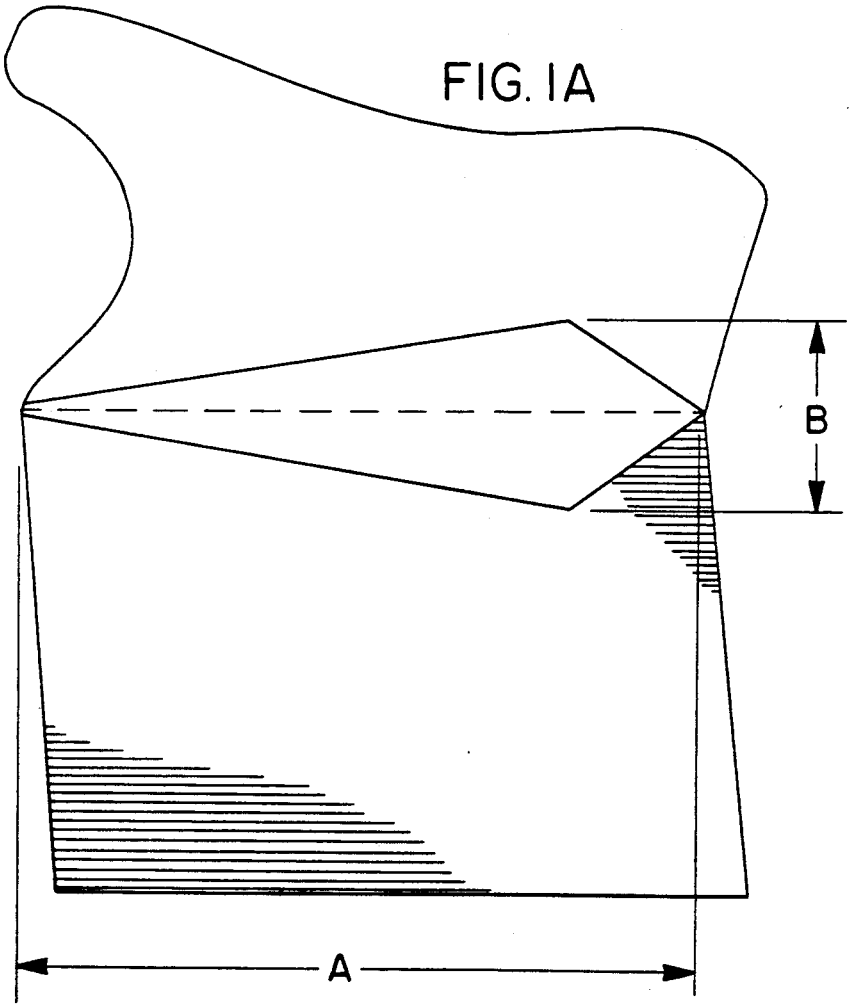
FIGS. 1A and 1B are plan views to illustrate the stitching of the FIG. 1 embodiment.
Figure 1B:
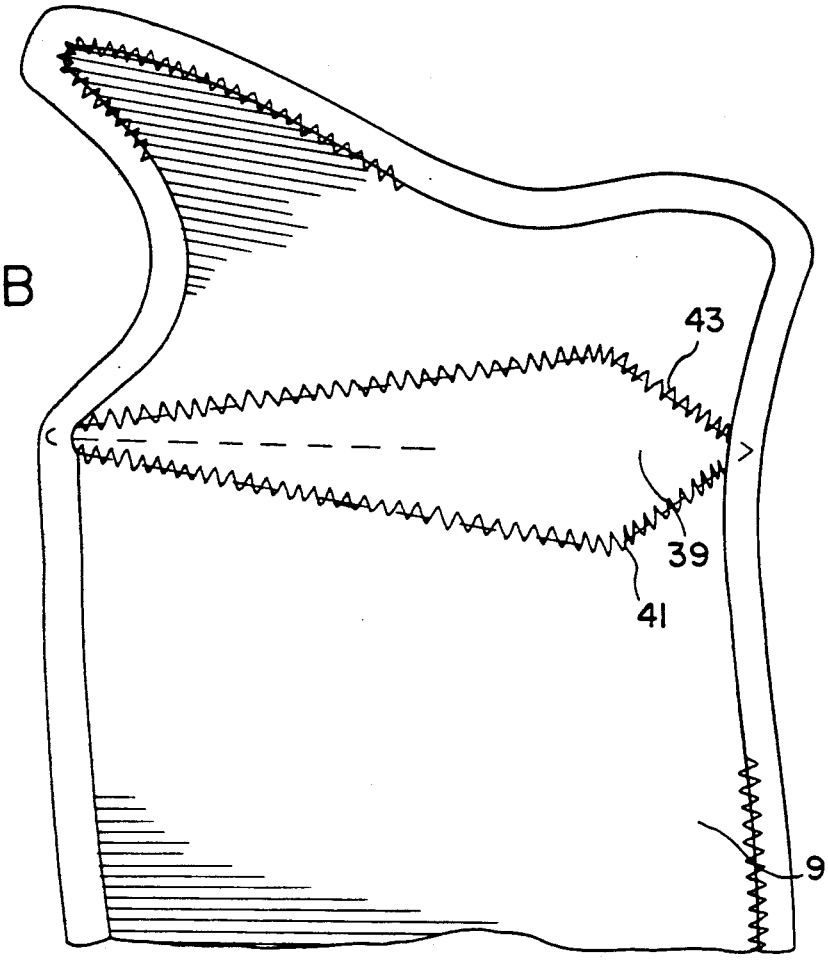

FIG. 1A shows the single piece of non fray elastic fabric as cut with fold marks B. The top fold mark is brought down to a position on the lower mark with an angled fold at each edge of the cut fabric. When attached along the fold lines at top and bottom as shown in FIG. 1B the upper portion of the brace when closed as worn on the hand forms a 32° angle at the same time producing three times the elastic power of the original fabric in the area 39.

Figure 2A:
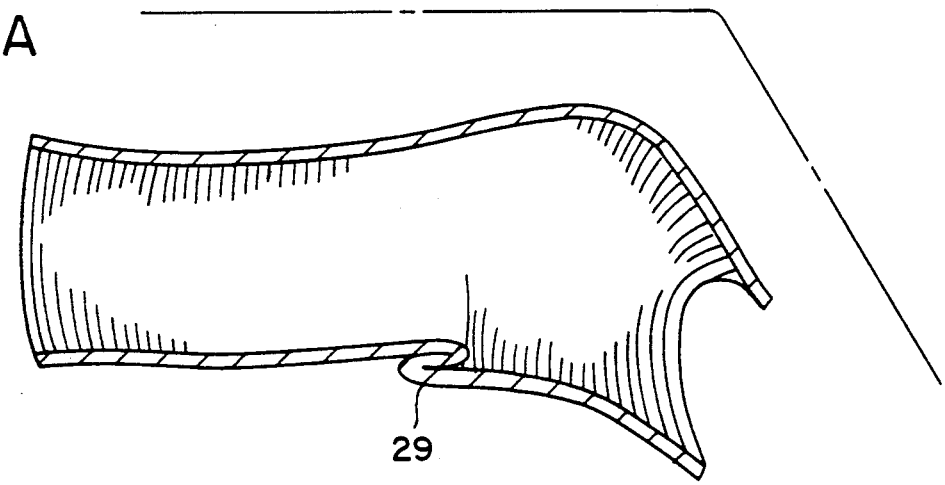
FIG. 2A is a cross section through the FIG. 2 embodiment.
Figure 2:
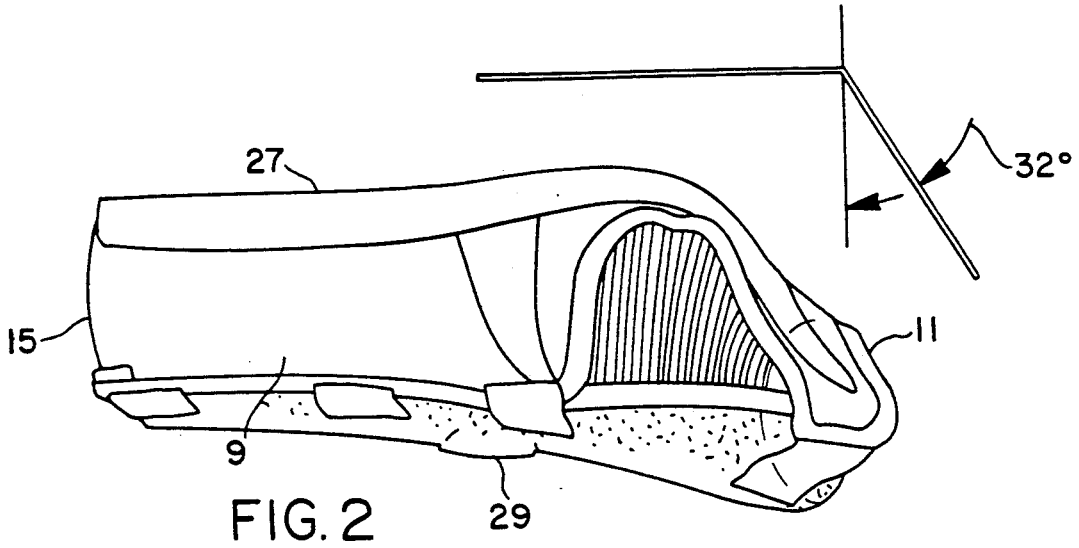
FIG. 2 of the drawings is a perspective view of the embodiment of FIG. 1 in the closed position.

FIG. 2 is a detailed view of the wrist brace 7 closed but without the hand. The body 9 is unlike prior art devices generally manufactured from a single piece of two-way uniformly elastic fabric. Such a fabric is shown in copending application Ser. No. 07/117,756 and Ser. No. 07/387,706. A fold 29 is formed by folding and sewing the fabric such that the area on the wrist adjacent the fold, which covers the carpal ligament 5 is provided with three times the tension as compared to the adjacent areas covered by the body 9. The process of the invention discussed below describes how the fold is formed. A pocket 27 on the palm side of the brace 7 extends longitudinally lengthwise from the area near the inner edge 15 to the outer edge 11 and is provided to carry a generally flat and angled splint (not shown). When in place on a hand, the splint and the fold cooperate to hold the hand in the proper healing position.

FIG. 2A shows the three fold section producing the increased tension needed over the carpal ligament.

Figure 3:
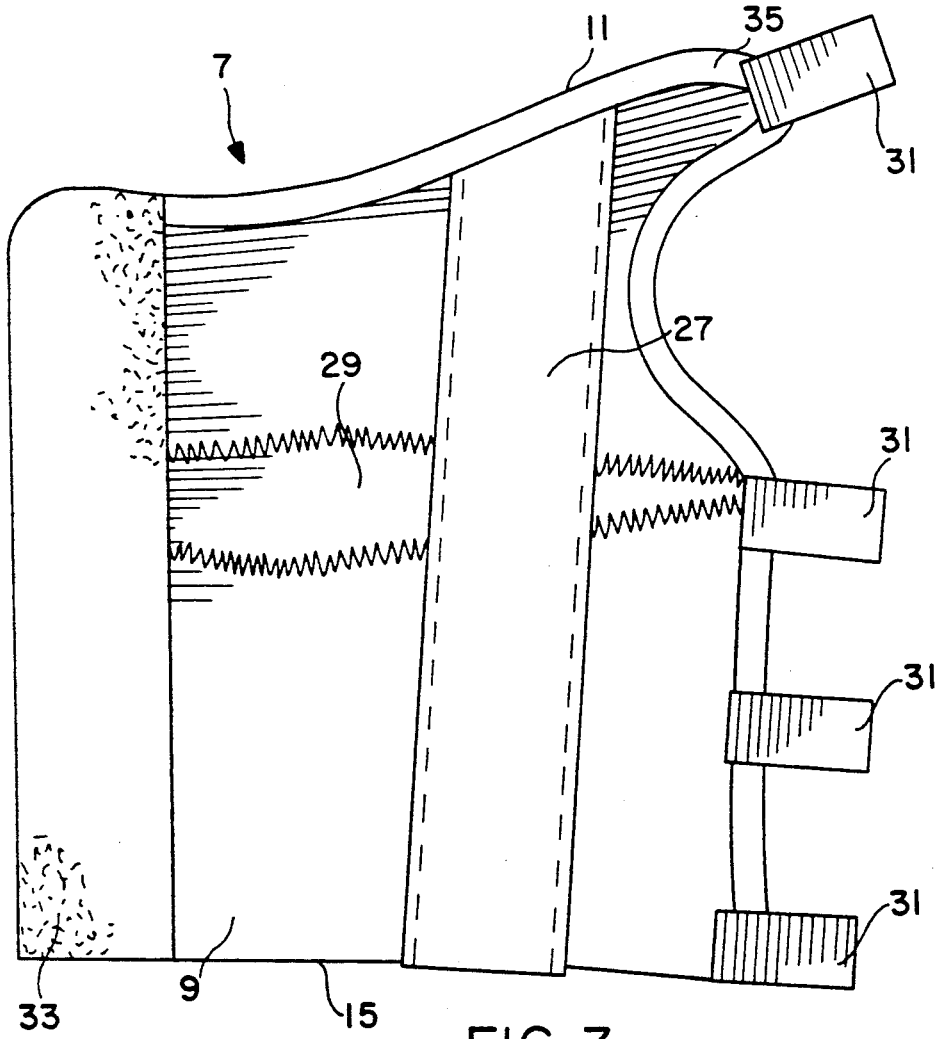
FIG. 3 of the drawings is a plan view of the embodiment of FIG. 1 as it would appear open and spread flat.

FIG. 3 is a view of the exterior of the wrist brace 7 opened and spread flatly. The brace 7 is provided with Velcro hooks 31 which are used in conjunction with Velcro pile 33 in a well known way to hold the brace 7 in place on the hand. A small additional piece 35 of fabric is attached along the outer edge 11 of the brace to provide a supplementary area of greater tension near the fingers.

Figure 4:
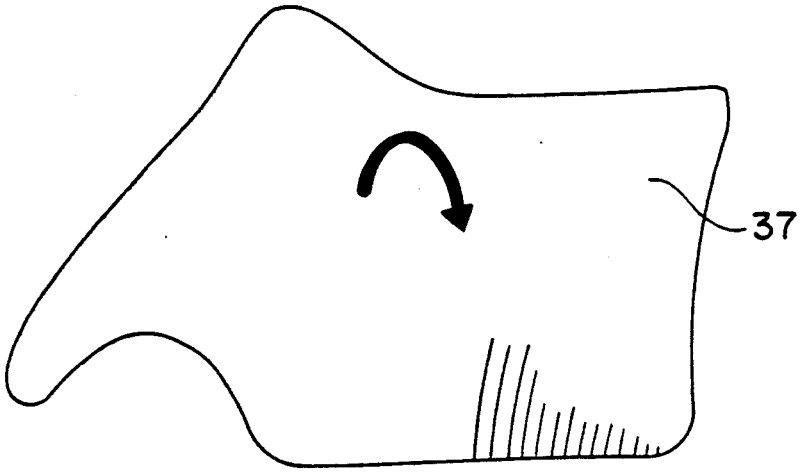
FIGS. 4, 5 and 6 of the drawings illustrates the steps of the process of the invention.

A fold, like fold 29 of the brace 7, can be formed in accordance with the process of the invention. FIG. 4 illustrates the first step of this process. A fabric 37 with elastic properties is folded to form a pleat 39 with two longitudinal edges, a base edge 41 and a top edge 43.

Figure 5:
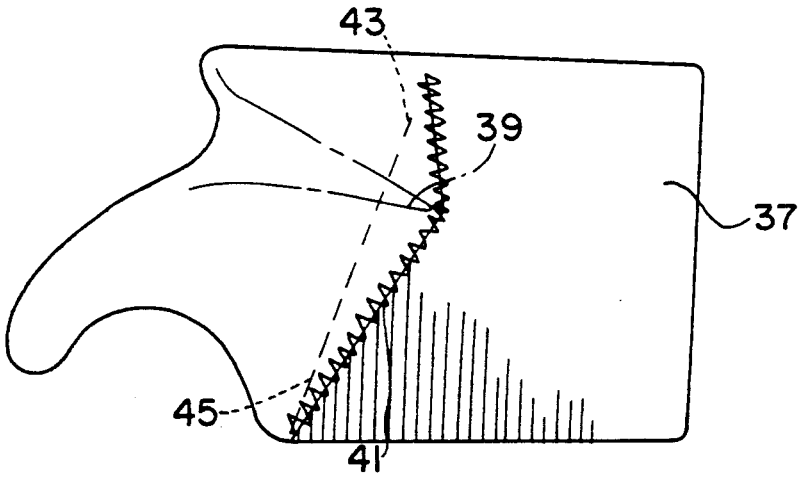

The second step of the process is shown in FIG. 5. The base edge 41 is folded down and is stitched together with stitching 45.

Figure 6:
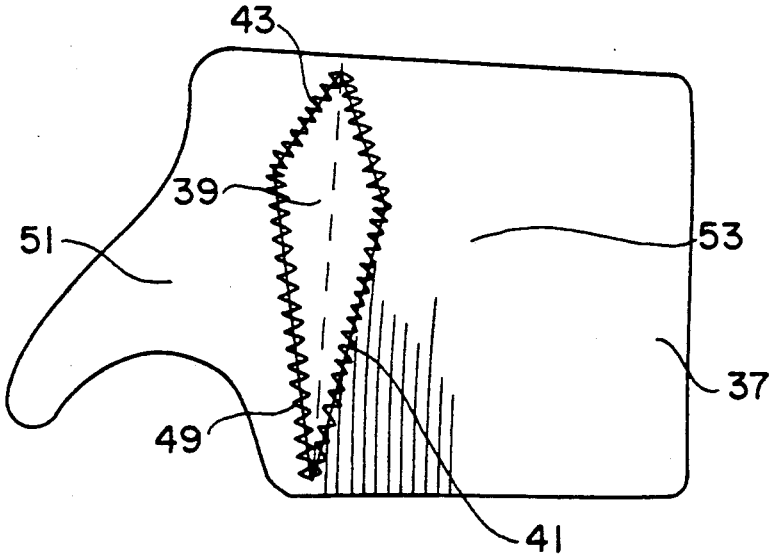

The final step of the process is illustrated by FIG. 6. The top edge 43 has been stitched to the rest of the fabric 37 with stitching 49. In this way, a fold 39 has been formed which provides an area with a spring constant three times as great as that of adjacent areas shown as 51 and 53 of fabric 37. Prior art orthopedic supports achieved this same result only with expensive dual-tension elastic material.

FIG. 7 illustrates an additional embodiment of the invention comprising generally an orthopedic support apparatus 55. The apparatus 55 is here shown to be a knee brace but, as one skilled in the art will recognize, different dimensions will allow a similar apparatus to function as an elbow brace. The apparatus 55 is constructed of one rectangular portion 57 of ravel-free two-way stretch fabric having edges 61, 63, 65 and 67 as illustrated in FIG. 8. Preferably, the fabric will be a ribbed plaited knit fabric of the type disclosed in U.S. Pat. No. 4,905,692, which is cross-referenced above. Edges 65 and 67 are generally severed from a continuous roll of fabric.

The two way stretch feature permits the front of the brace to stretch longitudinally when the knee is flexed and when the knee is straightened the elastic to return its original position thus eliminating troublesome wrinkles experienced with one way stretch fabric.

FIG. 9 shows the assembly of the knee brace with cut dart edges joined 68 and the cut edges 65 and 67 joined to complete the brace using non fray two way stretchable fabric.

Figure 10:
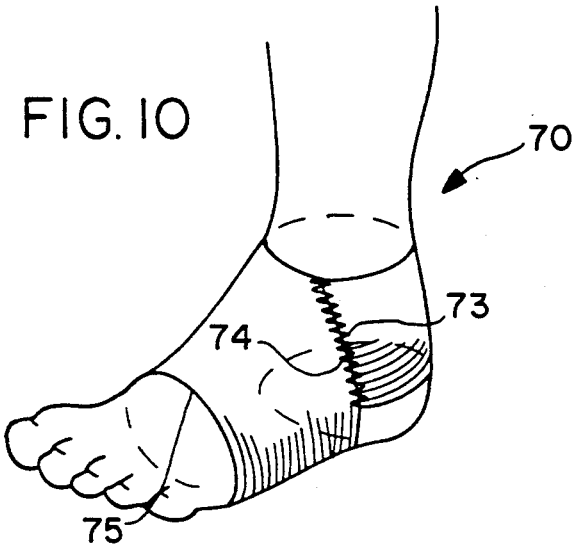
FIG. 10 of the drawings is a perspective view of another alternative embodiment of the invention as it appears when worn on the ankle.
Figure 11:
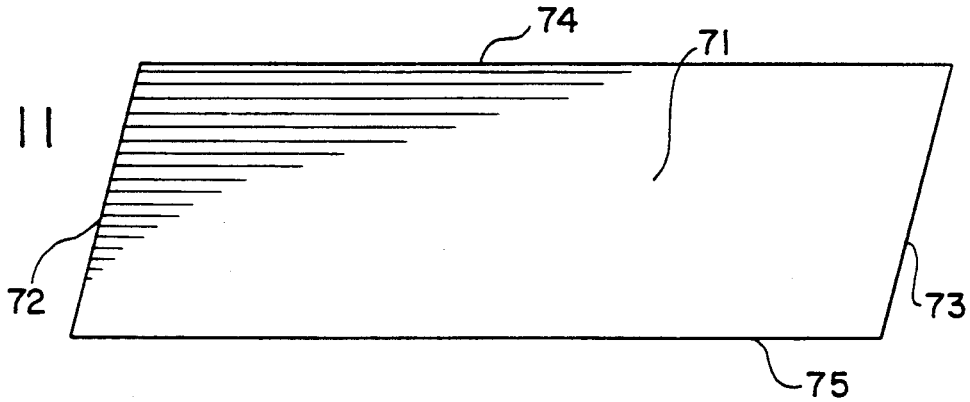
FIG. 11 is a plan view of the embodiment of FIG. 10 spread flatly with stitching removed.

FIG. 10 illustrates a further embodiment of the invention comprising generally an orthopedic ankle support. The apparatus 70 is constructed on one rectangular portion 71 of ravel-free two way stretch fabric having edges 72, 73 74 and 75 as illustrated in FIG. 11. Edges 72 and 73 are generally severed from a continuous roll of fabric.

Normally braces of this type are cemented or latexed along the severed ends 72 and 73 to prohibit unraveling and runback of the elastic yarn where cut. The cement or latex is an expensive operation, is unsightly since it changes the appearance of the fabric and can be a cause of irritation to sensitive skin. The ravel free two way stretch fabric of this invention requires no treatment of the cut edge, is non allergenic and more comfortable to the wearer.

Figure 12:
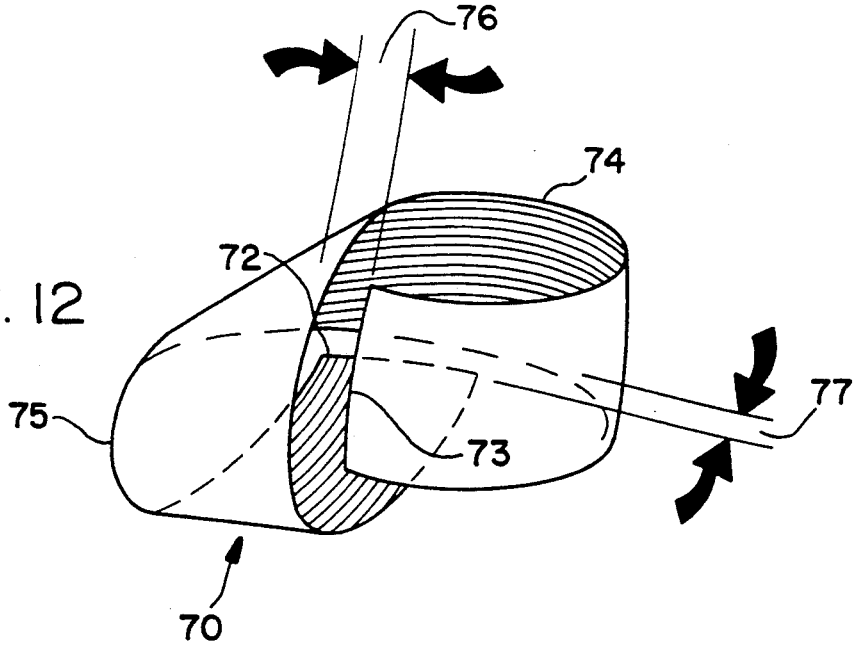
FIG. 12 of the drawings is a perspective view of the material in FIG. 11 illustrating the manner in which the material must be folded to form the embodiment of the invention shown in FIG. 10.

The rectangular portion 71 is folded as shown in FIG. 12 to form the shape of the apparatus. End 73 is brought as illustrated by arrow 76 to a position flatly abutting the edge 75 and stitched in place. End 72 is brought to edge 74 as shown by arrow 77.

Related prior art apparatus used raveling fabric and, therefore, required that both edges be latexed or cemented to prevent fraying of the edges. However, the instant invention uses ravel-free fabric and, accordingly, allows the respective edges to abut without latex or cement. The resulting advantage is much greater versatility in the type of stitching that can be used is more comfortable and nonallergenic. Some of the other types of stitching possible are, for example, surge stitch, cover stitch or flat lock stitch.

It is thus seen that the instant invention provides a novel orthopedic support apparatus. It is further seen that the invention provides a novel process for the manufacture of an orthopedic apparatus with increased features of comfort, appearance and cost.

As many variations are apparent to one of skill in the art from a reading of the above specification, such variations are within the spirit and scope of the instant invention as defined by the following appended claims.

That which is claimed is:

1. An orthopedic support apparatus comprising a ribbed plaited knit two way stretch fabric having a ravel free severed end portion joined flatly to and abutting another portion of said fabric and secured thereto only by stitching.

2. The orthopedic support apparatus according to claim 1 wherein said stitching is a surge stitch.

3. The orthopedic support apparatus according to claim 1 wherein said stitching is a cover stitch.

4. The orthopedic support apparatus according to claim 1 wherein said stitching is a flat lock stitch.

* * * * *